US008628266B2

(12) United States Patent
Martin, Jr.

(10) Patent No.: US 8,628,266 B2
(45) Date of Patent: Jan. 14, 2014

(54) KNIFE WITH INTEGRATED DISPENSER

(76) Inventor: Edgar Virgil Martin, Jr., Temecula, CA (US)

( * ) Notice: Subject to any disclaimer, the term of this patent is extended or adjusted under 35 U.S.C. 154(b) by 798 days.

(21) Appl. No.: 12/427,105

(22) Filed: Apr. 21, 2009

(65) Prior Publication Data

US 2009/0297248 A1 Dec. 3, 2009

Related U.S. Application Data

(60) Provisional application No. 61/130,194, filed on May 29, 2008.

(51) Int. Cl.
*A47L 13/30* (2006.01)

(52) U.S. Cl.
USPC ..... 401/261; 401/183; 401/263; 30/123.3; 222/191; 222/192

(58) Field of Classification Search
USPC ..... 401/123, 130, 132–134, 183–185, 261, 401/265, 266, 143, 263; 222/541.1, 541.6, 222/541.9, 191, 192, 92, 94, 105, 106, 207, 222/210, 608, 628; 206/229; 30/123.3, 141
See application file for complete search history.

(56) References Cited

U.S. PATENT DOCUMENTS

| | | | | | |
|---|---|---|---|---|---|
| 2,496,908 | A | * | 2/1950 | Doux | 294/50 |
| 3,090,071 | A | * | 5/1963 | Le Brooy | 401/266 |
| 3,113,703 | A | * | 12/1963 | Rundle | 401/139 |
| 3,214,781 | A | | 11/1965 | Johnson et al. | |
| 3,410,457 | A | * | 11/1968 | Brown | 222/191 |
| 3,418,059 | A | * | 12/1968 | Robe | 401/266 |
| D267,537 | S | * | 1/1983 | Borer | D7/653 |
| 4,648,506 | A | * | 3/1987 | Campbell | 206/216 |
| 4,841,637 | A | * | 6/1989 | Scholzen | 30/125 |
| 4,888,188 | A | * | 12/1989 | Castner et al. | 426/109 |
| 5,111,932 | A | * | 5/1992 | Campbell | 206/216 |
| 5,255,438 | A | * | 10/1993 | Morgan | 30/254 |
| 5,529,224 | A | * | 6/1996 | Chan et al. | 222/212 |
| 5,890,630 | A | * | 4/1999 | Lobdell | 222/192 |
| 5,894,959 | A | * | 4/1999 | Sigurlidason | 222/192 |
| 6,224,574 | B1 | * | 5/2001 | Al-Labban | 604/187 |
| 6,347,727 | B1 | * | 2/2002 | Diaz | 222/101 |
| 6,352,465 | B1 | * | 3/2002 | Heymann et al. | 446/473 |
| 6,663,019 | B2 | * | 12/2003 | Garcia et al. | 239/327 |
| 7,226,230 | B2 | * | 6/2007 | Liberatore | 401/266 |
| 7,703,619 | B2 | * | 4/2010 | Van Puijenbroek | 220/4.21 |
| 2001/0045374 | A1 | * | 11/2001 | Selker | 206/542 |
| 2008/0121658 | A1 | * | 5/2008 | Rosner et al. | 222/158 |

* cited by examiner

*Primary Examiner* — David Walczak
*Assistant Examiner* — Jennifer C Chiang
(74) *Attorney, Agent, or Firm* — Felix L. Fischer

(57) ABSTRACT

A knife with integrated dispenser incorporates a blade terminating at a boss. A handle extends from the boss with a condiment container connected to the handle and the boss. A conduit extending through the boss and communicating with the condiment container terminates in an aperture adjacent the blade for extruding condiment.

5 Claims, 11 Drawing Sheets

KNIFE WITH INTEGRATED DISPENSER

REFERENCES TO RELATED APPLICATIONS

The present application claims priority of the provisional application having Ser. No. 61/130,194 filed on May 29, 2008 by Edgar Virgil Martin, Jr. entitled Cut-n-spread knife.

BACKGROUND

1. Field

This invention relates generally to the field of kitchen or picnic utensils and, more particularly, to a knife having a blade and further having an integrated container for a condiment and flow conduit with an aperture adjacent the blade face for extruding the condiment.

2. Description of the Related Art

Condiments such as cream cheese or other soft cheese spreads, mayonnaise or mustard typically require spreading onto bread with a knife. While squeeze bottles provide a certain capability for distributing such condiments onto a slice of bread, roll, bagel or other food stuff, the amount of condiment and the evenness of the distribution on the food stuff is often not as desired.

Certain integrated dispensing spreaders have been proposed such as that disclosed in U.S. Pat. No. 3,214,781 issued on Nov. 2, 1965, however, such spreaders do not provide full capability as a knife for cutting bread, bagels or other food stuffs.

It is therefore desirable to provide a knife having full capability to cut and bread or other food stuffs while having an integral condiment storage and supply capability.

SUMMARY

The embodiments disclosed herein provide a knife with an integrated condiment dispenser. A blade terminates at a boss and a handle extends from the boss with a condiment container connected to the handle and the boss. A conduit extending through the boss and communicating with the condiment container terminates in an aperture adjacent the blade for extruding condiment.

In a first embodiment, the handle is an arcuate member extending from the boss with an ovaloid pliable condiment container suspended within the arcuate member. A second configuration of this embodiment includes an arcuate bottom element extending from the handle to encircle the condiment container.

In a second embodiment, the handle extends from the boss with an integral reservoir having a piston to extrude condiment through the conduit in the boss. A removable portion of the handle allows filling of the reservoir with condiment and provides for an actuator attached by a shaft to the piston.

BRIEF DESCRIPTION OF THE DRAWINGS

Embodiments which demonstrate the characteristics of the invention are set forth in the following detailed description. These embodiments, both as to their construction and method of operation, together with additional advantages thereof, will be best understood from the following description when read and understood in connection with the accompanying drawings wherein.

DETAILED DESCRIPTION

Figure 1:
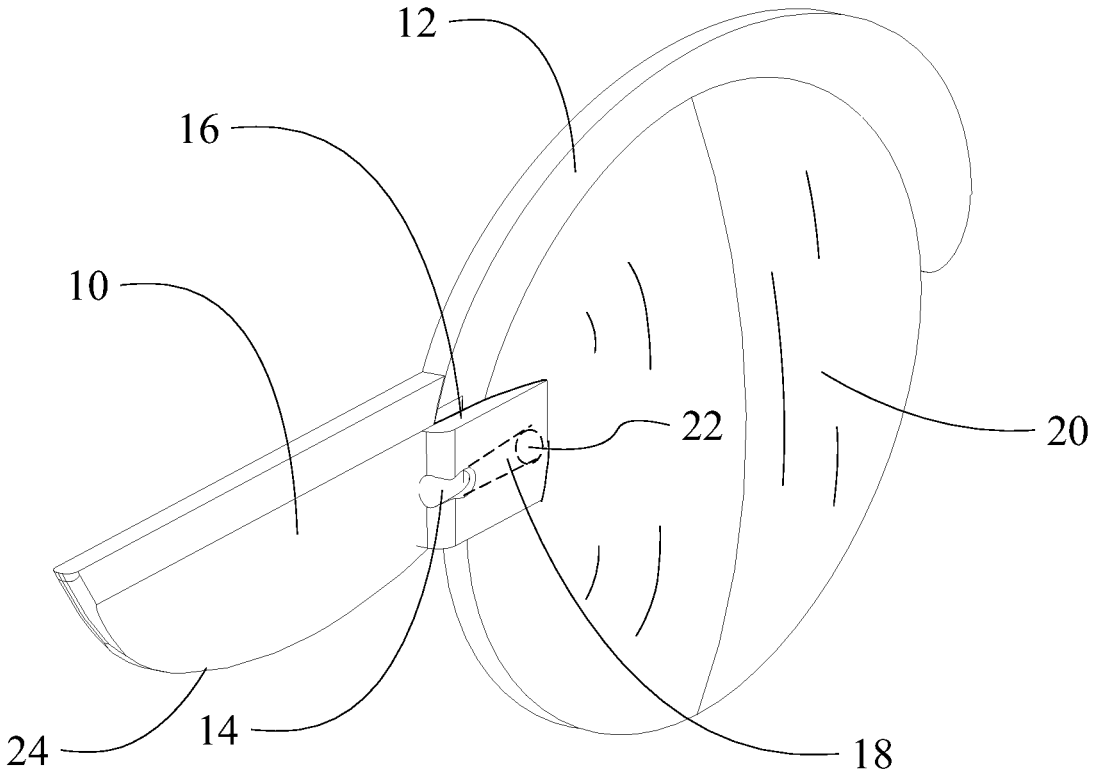
FIG. 1 is an isometric view of a first embodiment of the integrated dispensing knife.
Figure 2A:
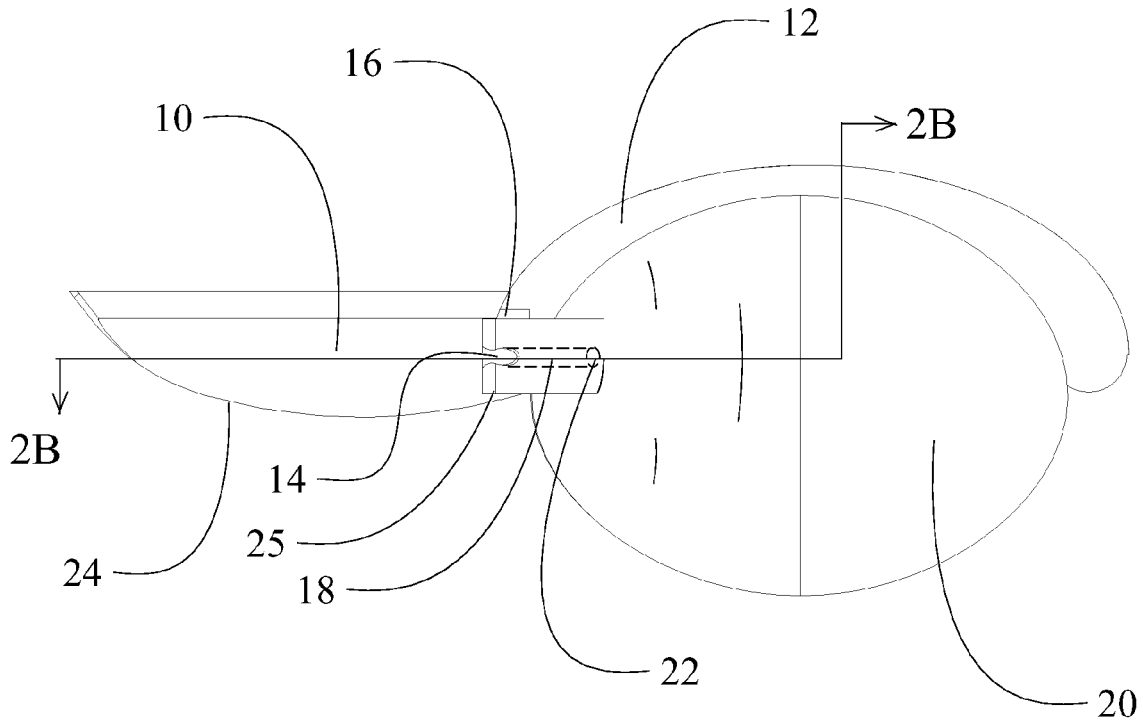
FIG. 2A is a side hidden line view of a first configuration of the embodiment shown in FIG. 1.
Figure 2B:
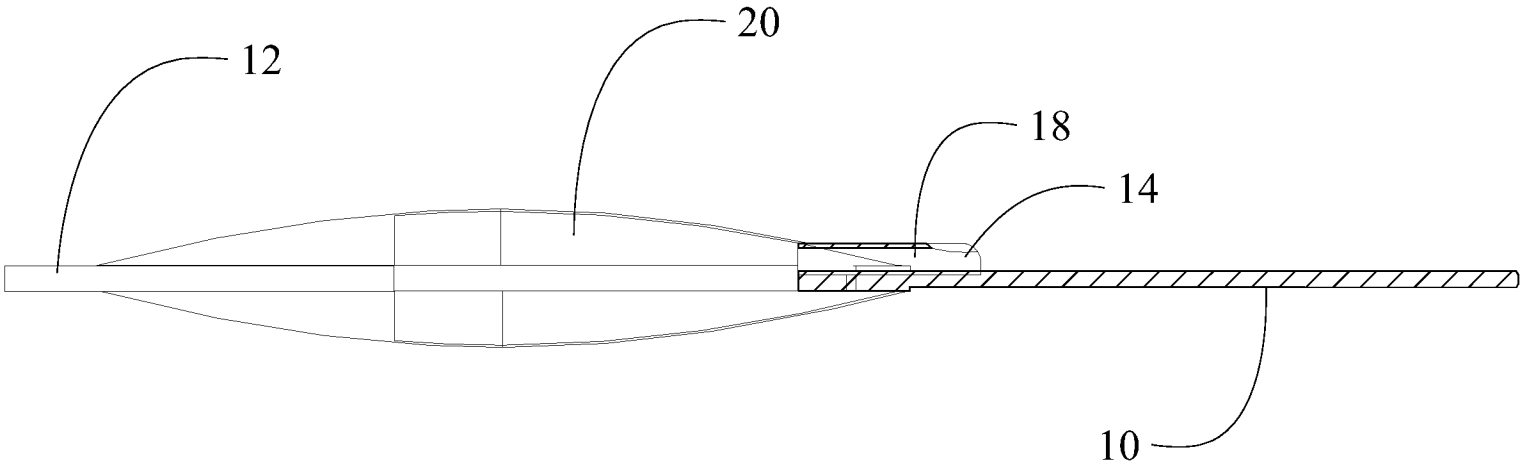
FIG. 2B is a top section view of the configuration of FIG. 2A.

Referring to the drawings, FIGS. 1, 2A and 2B show a first embodiment having a knife blade 10 extending from an arcuate handle 12. An aperture 14 adjacent a base 16 of the blade terminates a conduit 18 which extends through the structure of the base. A pliant condiment container 20, which in certain configurations of the embodiment may be a membrane of metal foil, rubber or resilient plastic such as polyethylene, is sealingly connected to the base with an exit 22 in alignment with the conduit for extrusion of the condiment carried in the container. The flexibility of the container allows it to be squeezed for urging the condiment into the conduit and out through the aperture onto the blade. The blade of the knife can then be used to spread the condiment on the receiving food stuff such as a bagel, muffin, toast or bread slice. As shown, the blade retains a cutting edge 24 for full functionality as a knife to cut or slice the food stuff with which the condiment may be employed. In alternative embodiments, the aperture may be placed at the intersection of the engagement boss 25 and the cutting edge at the handle to dispense condiment in alignment with the cutting edge.

Figure 2C:
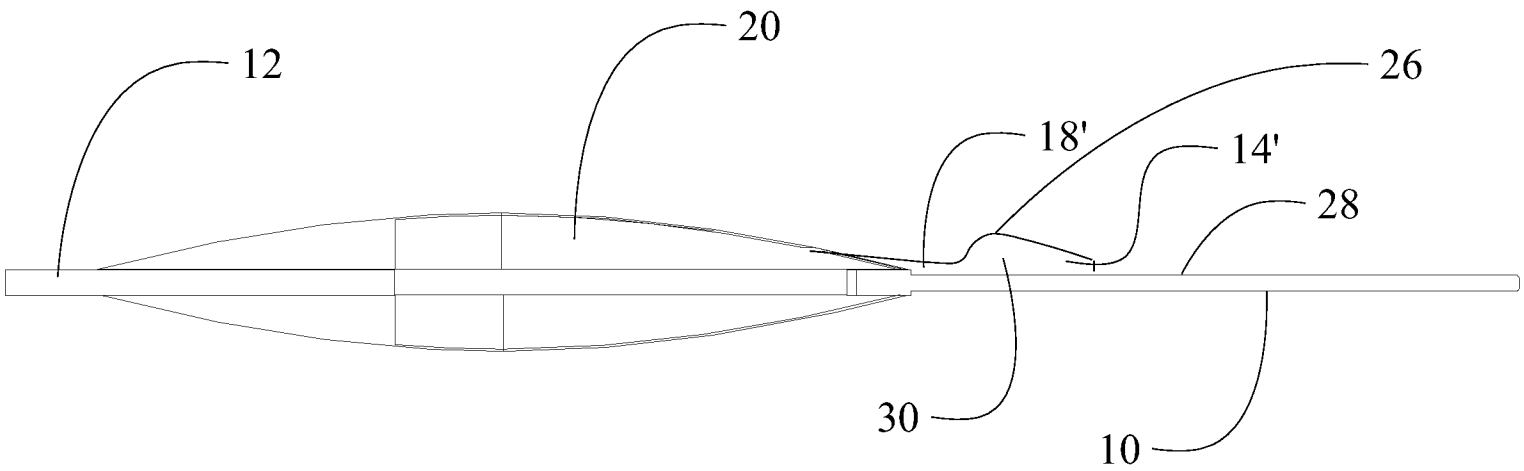
FIG. 2C is a top section view of an alternative configuration.

As shown in FIG. 2C, the conduit 18' and aperture 14' may an extension 26 of the flexible metal or plastic container which is sealed at the top and bottom edges to the side surface 28 of blade 10. For the configuration shown, the extension incorporates a relieved or bulged portion 30 to assist in regulating the flow of condiment from the container. In this configuration a "tear tab" may be provided over aperture 14' to seal the container prior to use or partial perforations in the material may be provided for preferential rupture at the termination of the extension upon exerting pressure on the container. In the embodiment of FIG. 2A, a membrane or sealing tape may be employed to seal the container with perforation of the membrane accomplished by squeezing the container with sufficient force to exceed the burst strength of the membrane with pressure in the condiment or by piercing the membrane with a sharp plunger or other object. If sealing tape is employed, the tape may be torn from the blade.

Figure 3:
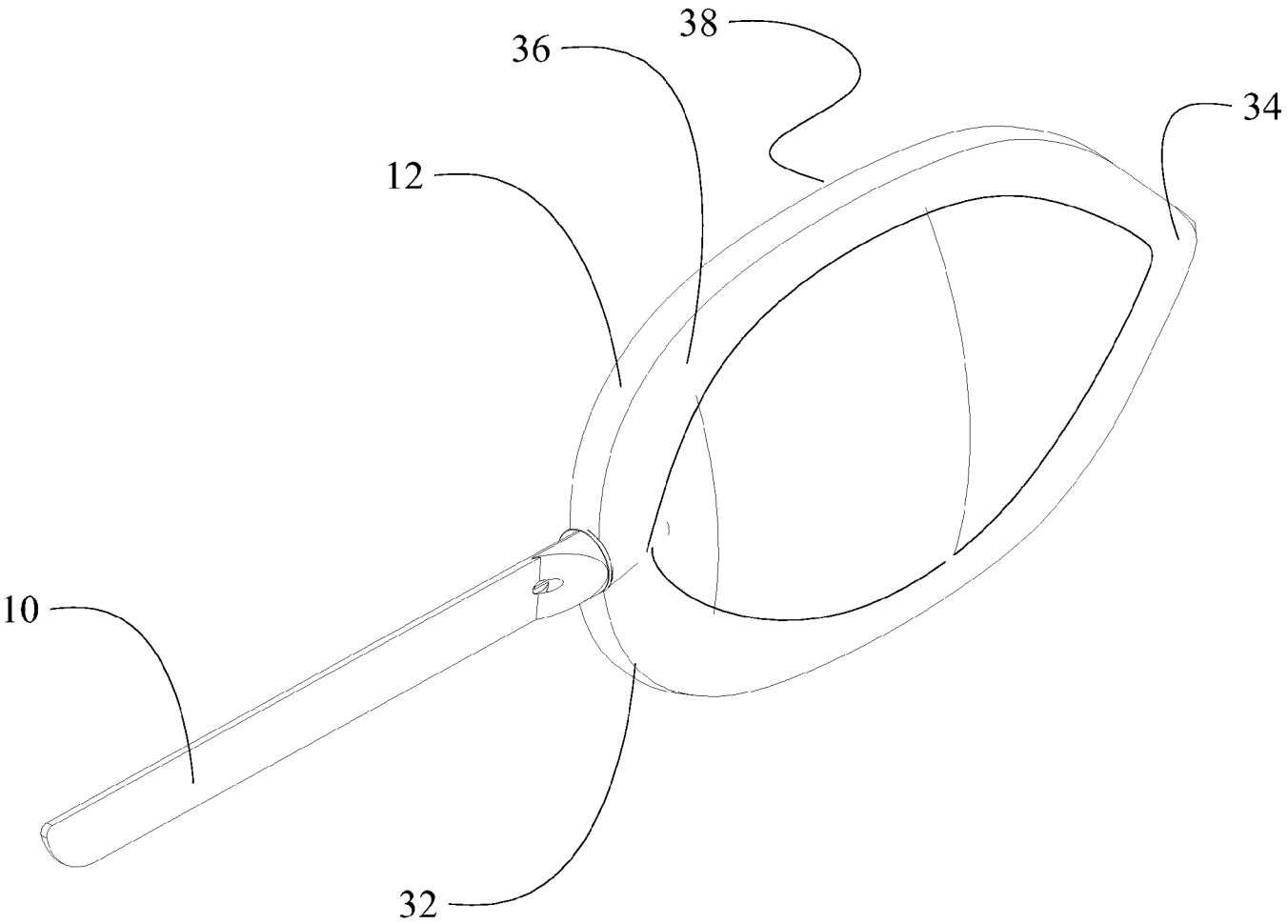
FIG. 3 is an isometric view of a second configuration of the first embodiment.
Figure 4A:
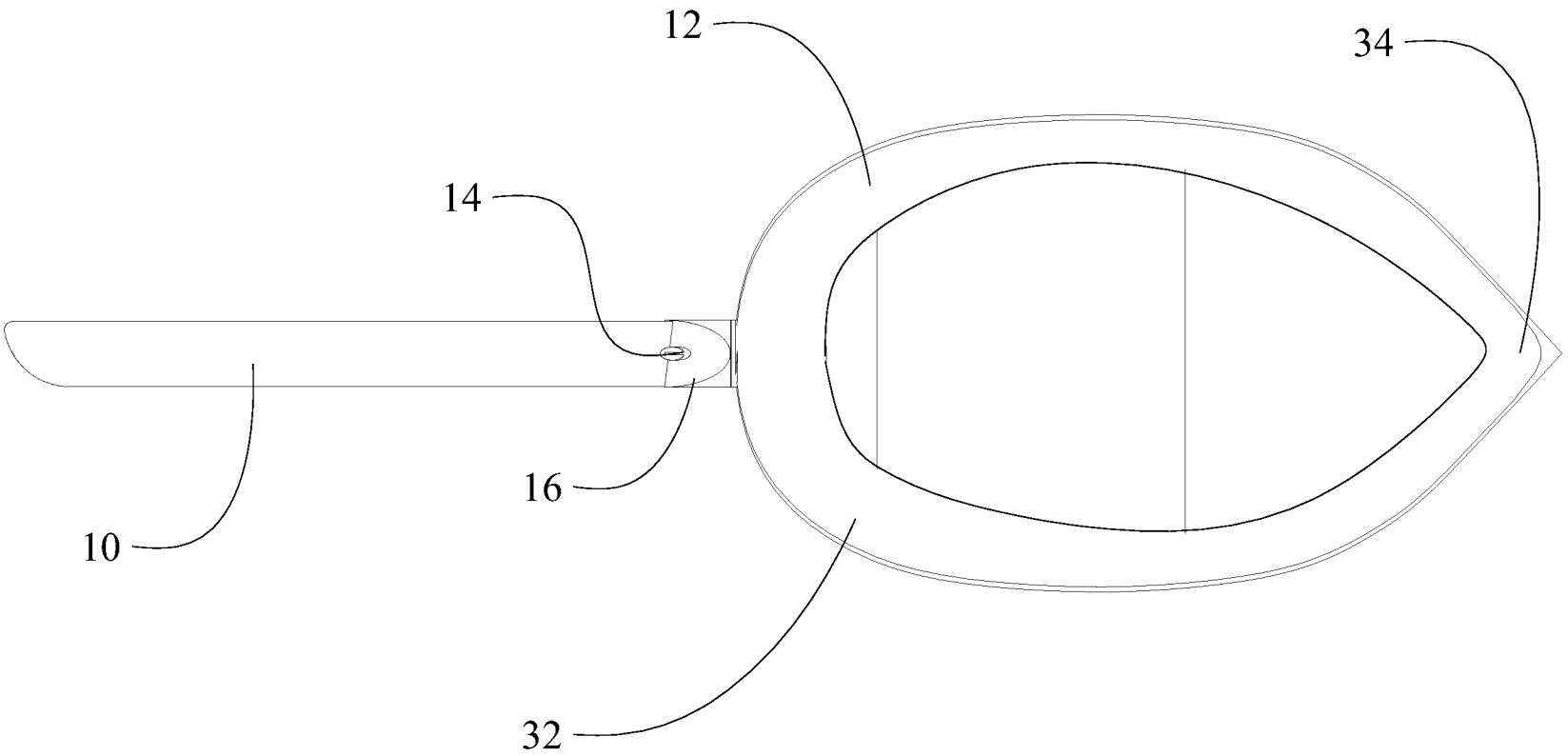
FIG. 4A is a side view of a second configuration of the embodiment shown in FIG. 4.
Figure 4B:
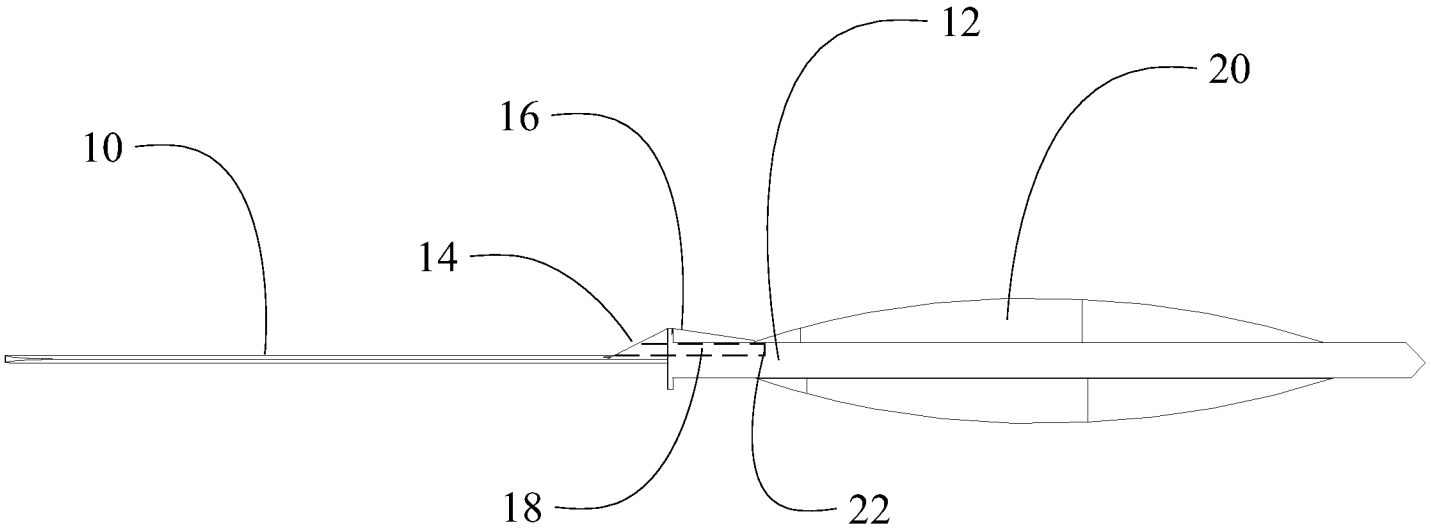
FIG. 4B is a top view of the second configuration.

FIGS. 3, 4A and 4B show a variation of the embodiment of FIG. 2A wherein an arcuate bottom structural element 32 extends from an end 34 of the arcuate handle to the blade base for additional rigidity. The container may be carried within the structural element or attached to it in alternate configurations. The container may be created with two sheets of resilient material placed on opposite sides of the handle and structural element and sealed to the faces 36 and 38 thereof. Interface with the conduit or creation of the conduit as a portion of the sealed resilient material is accomplished as previously described with respect to FIGS. 2B and 2C.

While shown as an arcuate or ovaloid shape in the embodiments of the drawings, the container and associated structural support may be square, rectangular or other convenient shape.

Figure 5:
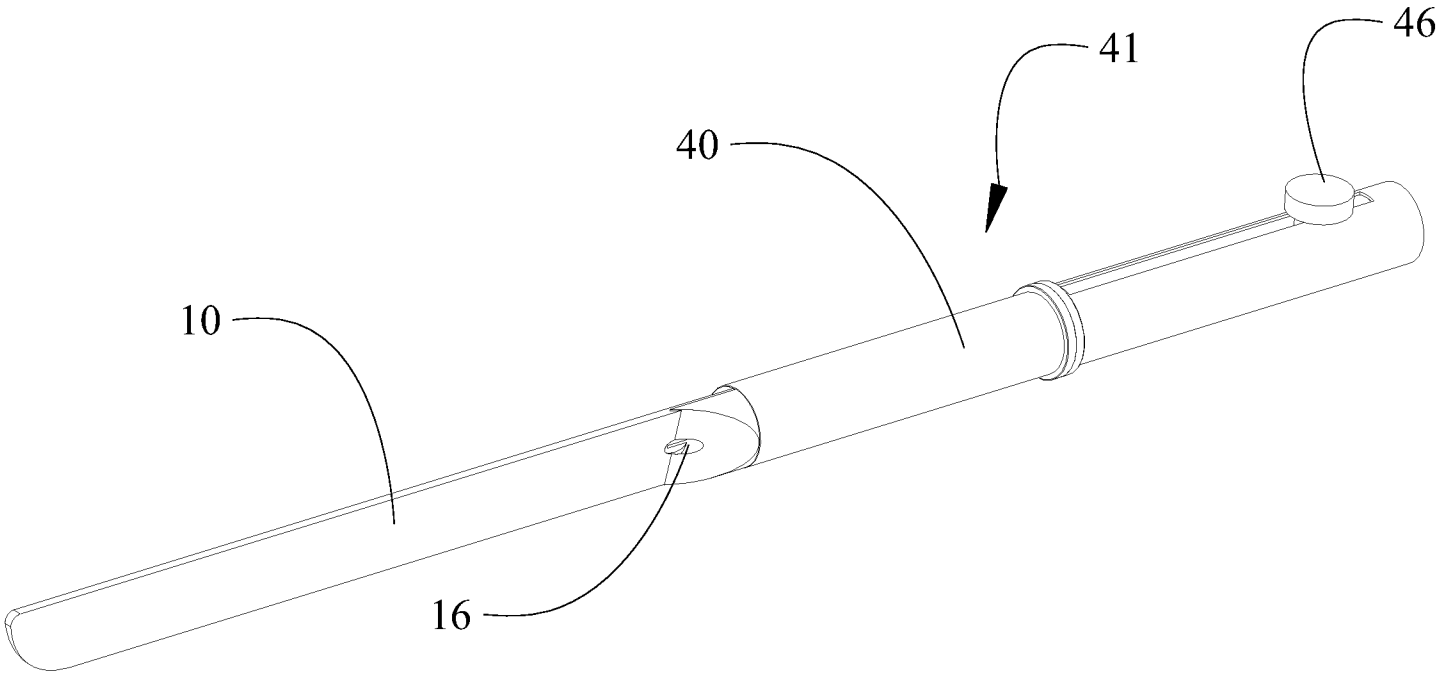
FIG. 5 is an isometric view of a second embodiment of the integrated dispensing knife.

FIG. 5 shows a second embodiment of the invention which employs a cylindrical reservoir 40 which extends from blade 10, either incorporated within or acting as the handle 41 for the knife. Conduit 18 communicates with the reservoir to allow condiment stored in the reservoir to be dispensed through aperture 14. For the embodiment shown in FIGS. 6A-6B, a piston 42 is carried in the reservoir. A shaft 44 extends from the piston and is attached to an actuator 46 extending through a slot 48 in the handle. By moving the actuator forward along the handle of the knife using a thumb or finger, a user urges the piston forward in the reservoir to displace condiment from the reservoir into the conduit and through the aperture. As described for the first embodiment, placement of the aperture on or adjacent the flat surface of the blade allows the condiment to be easily spread on the receiving food such as a bagel or bread slice using the knife.

Figure 6A:
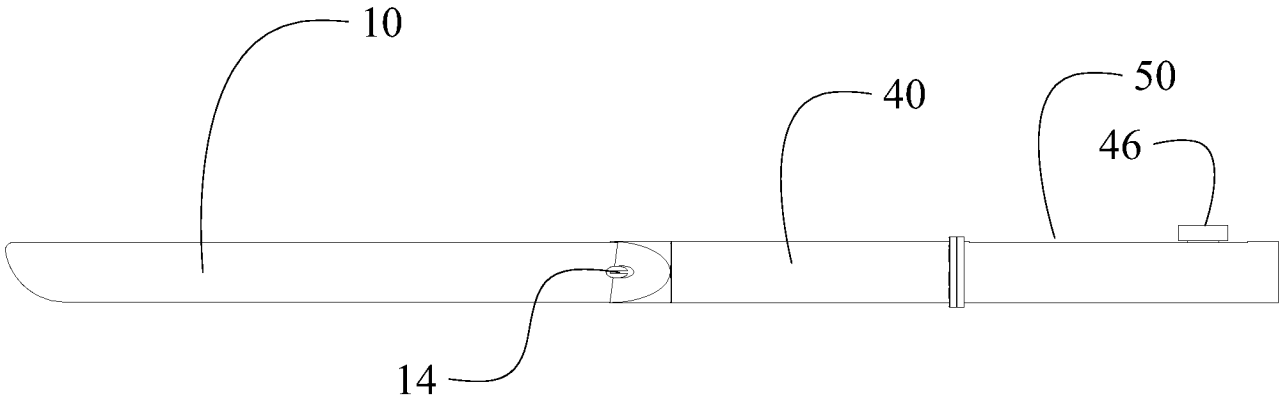
FIG. 6A is a side section view of the second embodiment shown in FIG. 5.
Figure 6B:
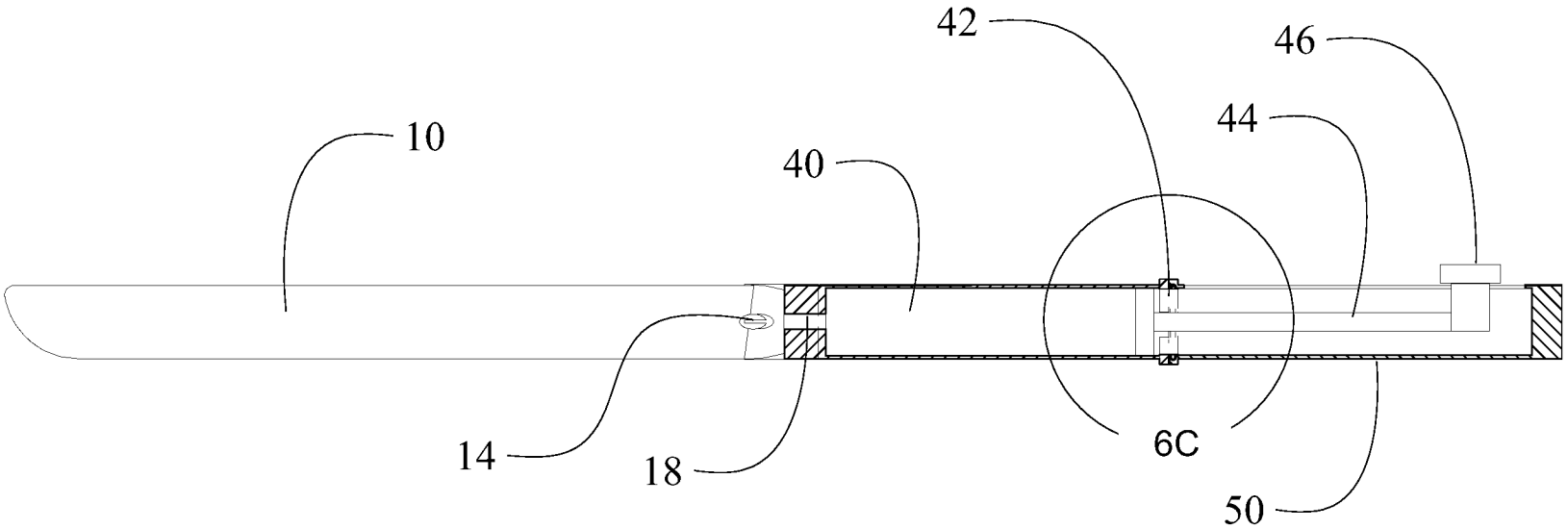
FIG. 6B is a top view of the second embodiment shown in FIG. 5.
Figure 6C:
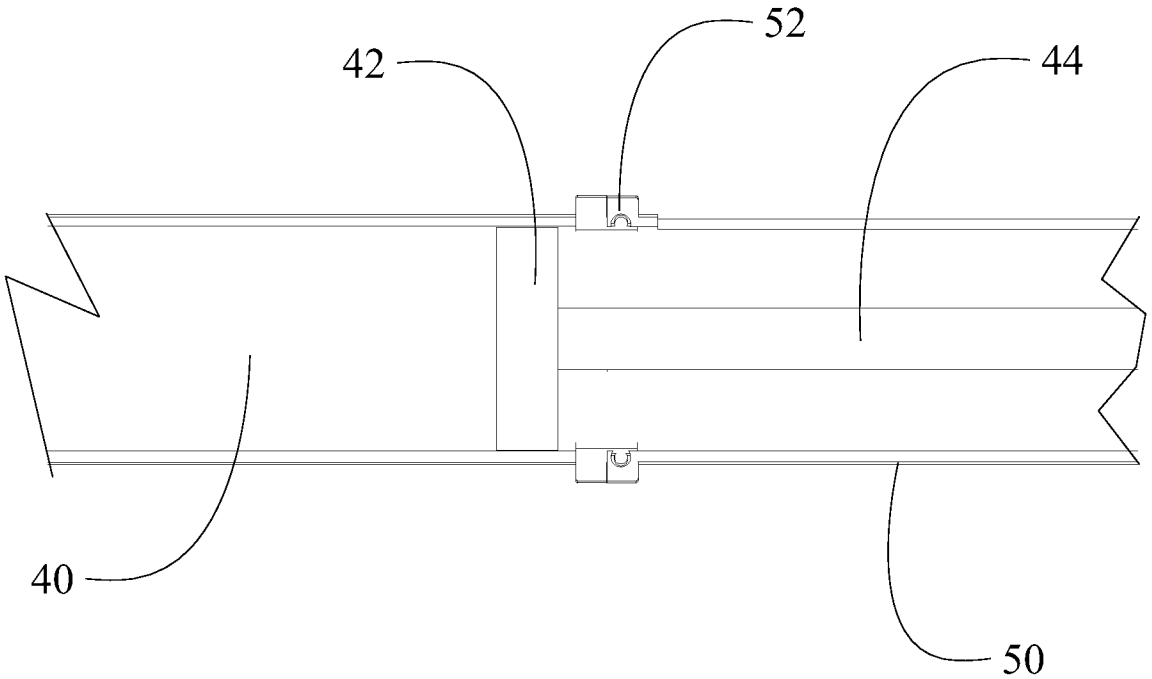
FIG. 6C is a detailed section view of the snap detent.

The embodiment shown in FIGS. 5 and 6A-6B may include a removable portion 50 which allows access to the reservoir for filling or refilling with condiment. For the embodiment shown, the piston, shaft and actuator are carried by the removable portion and are extracted from the reservoir when separated. A snap detent 52 as shown in detail FIG. 6C or threaded screw attachment may be employed for the removable portion to engage the reservoir case. In alternative embodiments, a plunger aligned with the shaft may be employed for actuating the piston similar to a syringe.

In various embodiments, the structural elements of the knife may be fabricated from plastic, brass, copper, wood or stainless steel with a round, square, hexagonal, octagonal, triangular or oval cross section. Foil, rubber, plastic or other resilient membrane or fabric may be employed for the flexible container elements. For inexpensive, mass producible materials, the entire combination may be disposable. Condiments such as cream cheese, jams, frosting, butter, peanut butter, mayonnaise, mustard, ketchup or other gel or viscous liquid may be employed with the embodiments shown. A sanitary tape or rupturable membrane is placed over the aperture to seal the condiment in the container to prevent contamination and/or drying out.

Having now described the invention in detail as required by the patent statutes, those skilled in the art will recognize modifications and substitutions to the specific embodiments disclosed herein. Such modifications are within the scope and intent of the present invention as defined in the following claims.

What is claimed is:

1. A knife with integrated dispenser comprising:

a blade having a cutting edge, said blade terminating at a boss;

a handle comprising an arcuate member extending in a single arc from the boss;

a pliable condiment container suspended within the arcuate member and connected to the boss; and, a conduit extending through the boss and communicating with the condiment container, the conduit terminating in an aperture adjacent the blade.

2. The knife as defined in claim 1 wherein the condiment container comprises a pliant ovaloid packet suspended within the arcuate member.

3. The knife as defined in claim 1 wherein the condiment container comprises resilient membrane selected from the set of foil, rubber or plastic.

4. A knife with an integrated dispenser comprising:

a blade having a cutting edge, said blade terminating at a boss;

an arcuate handle extending in a single arc from the boss;

a pliant ovaloid packet suspended within the arcuate handle and sealingly connected to the boss; and, a conduit associated with the boss and communicating with the condiment container, the conduit terminating in an aperture adjacent the blade.

5. The knife as defined in claim 4 wherein the conduit comprises an extension of the condiment container sealingly attached to the boss and having a tear tab adjacent the blade to create the aperture.

* * * * *